US010340591B2

(12) United States Patent
Hsieh et al.

(10) Patent No.: US 10,340,591 B2
(45) Date of Patent: Jul. 2, 2019

(54) ANTENNA WITH BRIDGED GROUND PLANES

(71) Applicant: HEWLETT-PACKARD DEVELOPMENT COMPANY, L.P., Houston, TX (US)

(72) Inventors: Chang-Cheng Hsieh, Taipei (TW); Hung-Wen Cheng, Taipei (TW); Leo Joseph Gerten, Austin, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 25 days.

(21) Appl. No.: 15/304,931

(22) PCT Filed: Apr. 29, 2014

(86) PCT No.: PCT/US2014/035780

§ 371 (c)(1),
(2) Date: Oct. 18, 2016

(87) PCT Pub. No.: WO2015/167445

PCT Pub. Date: Nov. 5, 2015

(65) Prior Publication Data

US 2017/0207525 A1 Jul. 20, 2017

(51) Int. Cl.

| | |
|---|---|
| ***H01Q 1/38*** | (2006.01) |
| ***H01Q 1/48*** | (2006.01) |
| ***H01Q 9/04*** | (2006.01) |
| ***H01Q 23/00*** | (2006.01) |

(52) U.S. Cl.

CPC ..... *H01Q 1/48* (2013.01); *H01Q 1/38* (2013.01); *H01Q 9/045* (2013.01); *H01Q 9/0407* (2013.01); *H01Q 23/00* (2013.01)

(58) Field of Classification Search

CPC ..... H01Q 1/48; H01Q 23/00; H01Q 9/0414; H01Q 1/526; H01Q 9/0421; H01Q 9/0407; H01Q 1/38

See application file for complete search history.

(56) References Cited

U.S. PATENT DOCUMENTS

| | | | | |
|---|---|---|---|---|
| 7,012,571 | B1 * | 3/2006 | Ozkar | H01Q 1/243 343/702 |
| 7,928,915 | B2 | 4/2011 | Sanz Arronte et al. | |
| 8,330,259 | B2 | 12/2012 | Soler Castany et al. | |
| 8,593,360 | B2 | 11/2013 | Baliarda et al. | |
| 2004/0201523 | A1 * | 10/2004 | Yuanzhu | H01Q 1/3275 343/700 MS |
| 2007/0120748 | A1 | 5/2007 | Jenwatanavet et al. | |
| 2010/0201588 | A1 | 8/2010 | Chen | |

(Continued)

FOREIGN PATENT DOCUMENTS

EP 2099093 A1 9/2009

*Primary Examiner* — Ricardo I Magallanes
(74) *Attorney, Agent, or Firm* — HPI Patent Department

(57) ABSTRACT

An antenna system with a bridged ground plane includes a printed circuit board, a first ground plane, a bridge, an antenna radiating element, an antenna connection, and at least one electronic component. The first ground plane is coupled to a first face of the printed circuit board. The bridge couples the first ground plane to the second ground plane. The antenna radiating element is coupled to the second ground plane via the antenna connection. The electronic component or components are coupled to a second face of the printed circuit board.

18 Claims, 5 Drawing Sheets

(56) References Cited

U.S. PATENT DOCUMENTS

| | | | | |
|---|---|---|---|---|
| 2011/0006953 | A1 | 1/2011 | Chiang et al. | |
| 2011/0170268 | A1* | 7/2011 | Takemura | H01L 23/552 361/748 |
| 2012/0092226 | A1* | 4/2012 | Baliarda | H01Q 9/0421 343/848 |
| 2012/0249386 | A1 | 10/2012 | Yanagi et al. | |
| 2012/0322373 | A1* | 12/2012 | Washiro | H01Q 1/2266 455/41.1 |
| 2013/0169504 | A1 | 7/2013 | Jenwatanavet | |
| 2016/0056544 | A1* | 2/2016 | Garcia | H01Q 21/28 343/725 |

* cited by examiner

ANTENNA WITH BRIDGED GROUND PLANES

BACKGROUND

Antennas are electrical devices that convert electrical power into electromagnetic waves and vice versa. In many antenna applications, such as in mobile computing devices, the size of a device may restrict the size of an antenna and its ground plane, which may affect performance of the antenna. For example, the bandwidth and efficiency of an antenna may be affected by the overall size, geometry, and dimensions of the antenna and the ground plane. Furthermore, an antenna's close proximity to other electronic components of a device may cause interfering noise between the antenna and the components.

BRIEF DESCRIPTION OF THE DRAWINGS

The following detailed description references the drawings, wherein.

DETAILED DESCRIPTION

Due to the current trend of decreasing sizes for mobile devices such as cellphones, tablet computers, etc., there has been significant interest in developing smaller, space-efficient antenna systems. Challenges arise because antennas need a large enough ground plane to operate at desired frequencies. Furthermore, with decreasing device size, electrical components and wiring inside the device become placed closer together, potentially leading to more unwanted electrical noise.

Examples disclosed herein provide for antenna systems with bridged ground planes. In example implementations, an antenna system includes two ground planes coupled via a conducting bridge. Generally, one ground plane connects to an antenna radiating element that provides the conversion between radio frequencies and electrical signals. A second ground plane may be a larger ground plane connected to a face of a motherboard of the device. By leveraging the bridge scheme, the larger motherboard ground plane may be used in addition to the first antenna ground plane to reflect radio waves. Furthermore, examples disclosed herein may include a filter scheme to filter noise between the antenna radiating element and other components of the antenna system. In this manner, example antenna systems disclosed herein minimize the required space of the antenna system by leveraging the bridge between an antenna ground plane and an adjacent motherboard ground plane.

Figure 1:
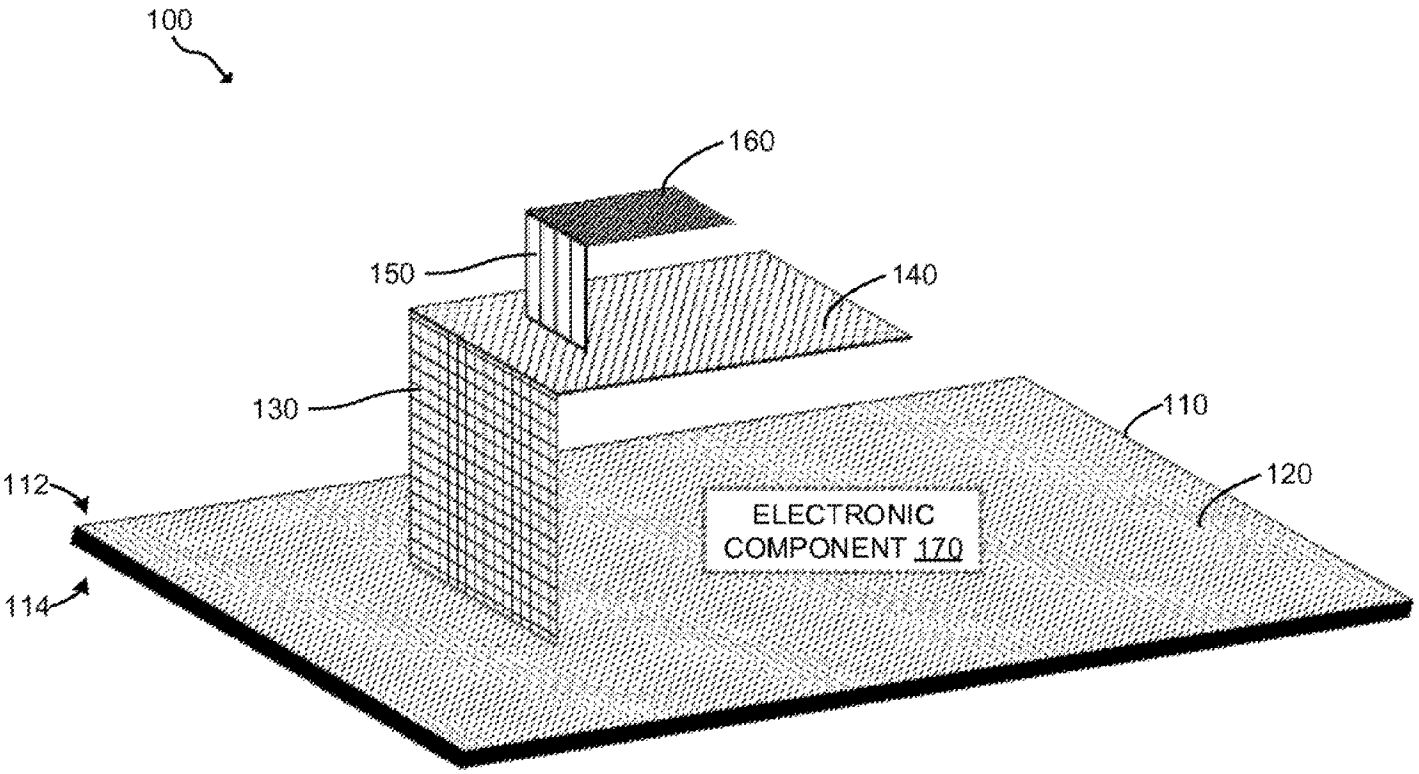
FIG. 1 is a block diagram of an example antenna system with bridged ground planes.

Referring now to the drawings, FIG. 1 depicts an example antenna system 100 with bridged ground planes. Antenna system 100 may be an electronic system that converts electrical power into radio waves (i.e., electromagnetic waves) and vice versa for transmitting and receiving data and/or communication. In transmission, antenna system 100 may convert an electric current to electromagnetic waves, which may be transmitted as radio frequencies. In receiving, antenna system 100 may intercept some power of an electromagnetic wave of a certain frequency to produce an electric current.

As depicted in FIG. 1, antenna system 100 may have a printed circuit board 110, a first ground plane 120, a bridge 130, a second ground plane 140, an antenna connection 150, an antenna radiating element 160, and at least one electronic component 170. First ground plane 120 may be coupled to a first face 112 of printed circuit board 110. Bridge 130 may couple first ground plane 120 to second ground plane 140. Antenna connection 150 may couple antenna radiating element 160 to second ground plane 140. Electronic component 170 may be coupled to a second face 114 of printed circuit board 110.

Printed circuit board 110 may be a mechanical support that electrically connects electronic components using conductive pathways between different electronic components and between printed circuit board 110 and electronic components. For example, printed circuit board 110 may be a motherboard or some other type of structure. In some implementations, printed circuit board 110 may have conductive tracks, pads, and other features etched from copper sheets laminated onto a non-conductive substrate. Printed circuit board 110 may be planar in configuration, having a first face 112 and a second face 114.

First ground plane 120 may be coupled to first face 112 of printed circuit board 110. First ground plane 120 may be an electrically conductive surface. When coupled to printed circuit board 110, first ground plane 120 may serve as a return path for current from different components on printed circuit board 110. In some examples, first ground plane 120 may cover the entire first face 112 of printed circuit board 110. First ground plane 120 may have an electrically conducting material, such as a layer of copper foil. Generally, first ground plane 120 may have a thin conducting layer.

Bridge 130 may couple first ground plane 120 to second ground plane 140. In one example, bridge 130 includes a copper foil. In some examples, such as illustrated in FIG. 1, second ground plane 140 is coupled to first ground plane 120 on first face 112 of printed circuit board 110. In other words, first ground plane 120 and second ground plane 140 are positioned closer to first face 112 than to second face 114. Alternatively, in other examples, first ground plane 120 and second ground plane 140 may be coupled on different faces of printed circuit board 110. For example, second ground plane 140 may be on second face 114 of printed circuit board 110 and coupled to first ground plane 120 by bridge 130 which passes through printed circuit board 110. These and similar examples are discussed in detail in relation to FIG. 2A and FIG. 2B.

Second ground plane 140 may be an antenna ground plane, which may be an electrically conducting surface that reflects radio waves from other elements, such as antenna radiating element 160. In some examples, second ground plane 140 may be at least a quarter of the wavelength of a radio wave in size in order to function as an antenna ground plane for that radio wave. Second ground plane 140 may be electrically conductive. For example, second ground plane 140 may be a layer of a metal foil, such as copper. Like first ground plane 120, second ground plane 140 may generally be a thin layer.

When second ground plane 140 and first ground plane 120 are coupled by bridge 130, first ground plane 120 may be leveraged to boost the performance of second ground plane 140. In some examples, such as ones described herein, first ground plane 120 may be larger than second ground plane 140 because first ground plane 120 may cover the entire first face 112 of printed circuit board 110. Accordingly, by leveraging the larger first ground plane 120, antenna system 100 may be resonant at lower frequencies than would be possible with solely using second ground plane 140.

Antenna connection 150 may couple antenna radiating element 160 to second ground plane 140. Antenna connection 150 may include a transmission line, where electric current is fed to and from antenna radiating element 160. The transmission line may be a number of different kinds of feeds, including an inset feed, a quarter-wavelength transmission line, a probe feed, a coupled/indirect feed, or an aperture feed. In addition, antenna connection 150 may include an electrical shorting pin coupled between first ground plane 140 and antenna radiating element 160. The shorting pin may operate to decrease the required size for the antenna. In some examples, the shorting pin may be placed at one end of antenna radiating element 160, and a transmission line may be placed between the shorted end and the opposite end of antenna radiating element 160. Furthermore, a shorting pin of antenna connection 150 may be a plate in some examples. Adjusting the width of the shorting plate may alter the resonant frequency of antenna radiating element 160.

Antenna connection 150 may include a number of materials, such as a conducting metal. In some examples, antenna connection 150 may include components made of copper. Lastly, antenna connection 150 may include other components, such as a capacitor coupled between second ground plane 140 and antenna radiating element 160. For example, the capacitor may operate to balance the capacitance and inductance of the antenna.

Antenna radiating element 160 may be a patch or other shape that radiates and receives radio waves. In some instances, antenna radiating element 160 may be a thin, polygonal-shaped patch. Antenna radiating element 160 may have an electrically conducting material, typically a metal. In many implementations, antenna radiating element 160 may be made of copper. In some examples, a substrate separates antenna radiating element 160 and second ground plane 140. in other words, second ground plane 140 and antenna radiating element 160 may sit on opposite faces of the substrate. A substrate may have a dielectric material that facilitates fringing electric fields between second ground plane 140 and antenna radiating element 160. Fringing electric fields may allow the system to operate similarly to a patch antenna or planar inverted-f antenna. A substrate may be any material with a dielectric constant, including mechanical structures or air. For the former examples, a substrate may provide mechanical support to the structure and may be, for example, a circuit board.

At least one electronic component 170 may be coupled to second face 114 of printed circuit board 110. Electronic component 170 may be any device that may be operable while coupled to printed circuit board 170. In some instances, electronic component 170 may be an electrical device that may operate on a motherboard. For example, electronic component 170 may be an integrated circuit or integrated circuit package, central processing unit, memory device, resistors, capacitors, and various other components. In some other instances, electronic component 170 may be an optical or other type of device that may operate with a circuit system. It should be noted that electronic component, as used herein, does not include first ground plane 120, bridge 130, second ground plane 140, antenna connection 150, or antenna radiating element 160. In some examples, all electronic components 170 that are coupled to printed circuit board 110 are coupled to second face 114 of printed circuit board 110. In other words, no electronic components are coupled to first face 112 of printed circuit board 110. For example, first face 112 has first ground plane 120 coupled to it and no electronic components.

Figure 2A:
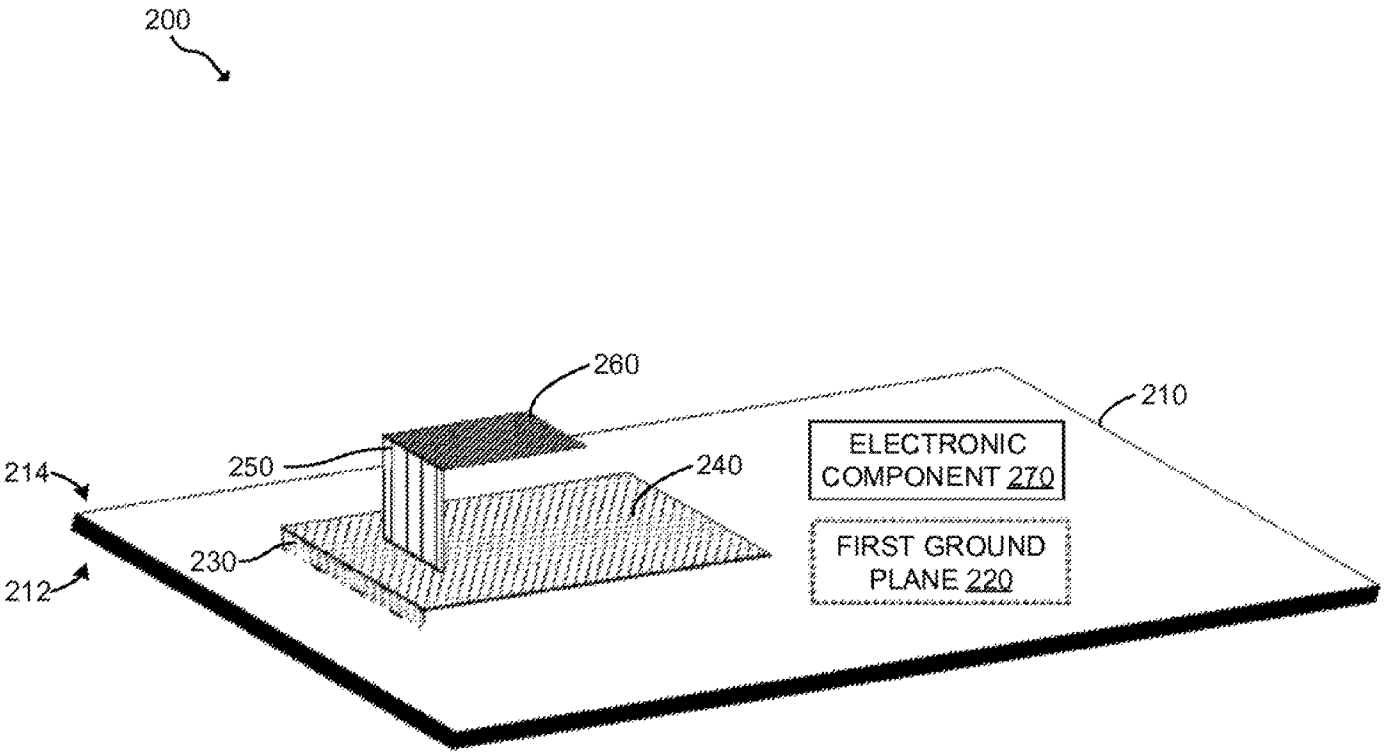
FIG. 2A is a block diagram of an example antenna system with bridged ground planes having a bridge passing through a motherboard.

FIG. 2A depicts an example antenna system 200 with bridged ground planes having a bridge 230 passing through a motherboard 210. Similar to antenna system 100 of FIG. 1, antenna system 200 may be an electronic system that converts electrical power into radio waves (Le., electromagnetic waves) and vice versa for transmitting and receiving data and/or communication. Antenna system 200 may have a motherboard 210, a first ground plane 220, a bridge 230, a second ground plane 240, an antenna connection 250, an antenna radiating element 260, and at least one electronic component 270.

Motherboard 210 may be a printed circuit board that supports and electrically connects various devices and components. First ground plane 220 may be coupled to a first face 212 of motherboard 210, which would be the bottom face of motherboard 210 as depicted in FIG. 2A. Dotted lines as used in the figures represents an element that is below, under, or otherwise concealed from direct view. Bridge 230 may couple first ground plane 220 to second ground plane 240. Antenna connection 250 may couple antenna radiating element 260 to second ground plane 240. Electronic component 270 may be coupled to a second face 214 of motherboard 210.

In some examples, such as the one depicted in FIG. 2A, first ground plane 220 and second ground plane 240 may be coupled on different faces of motherboard 210. For example, second ground plane 240 may be on second face 214 of printed circuit board 210 and coupled to first ground plane 220 by bridge 230 which passes through motherboard 210. In such examples, second ground plane 240 and electronic component 270 may both be coupled to the same face of motherboard 210, which is second face 214 in the example depicted. Bridge 230 may have an electrically conducting material, such as a copper foil.

Second ground plane 240 may have a variety of shapes. For example, second ground plane 240 may have a polygonal shape. In some implementations, second ground plane 240 may be a rectangular foil of copper. In examples where second ground plane 240 has a rectangular shape, bridge 230 may couple each edge of second ground plane 240 to first ground plane 220. Alternatively, antenna system 200 may have multiple bridges 230 that couple each edge of second ground plane 240 to first ground plane 220. Coupling each edge of second ground plane 240 to first ground plane 220 via bridge 230 may help maintain zero volt differential on the ground planes.

Figure 2B:
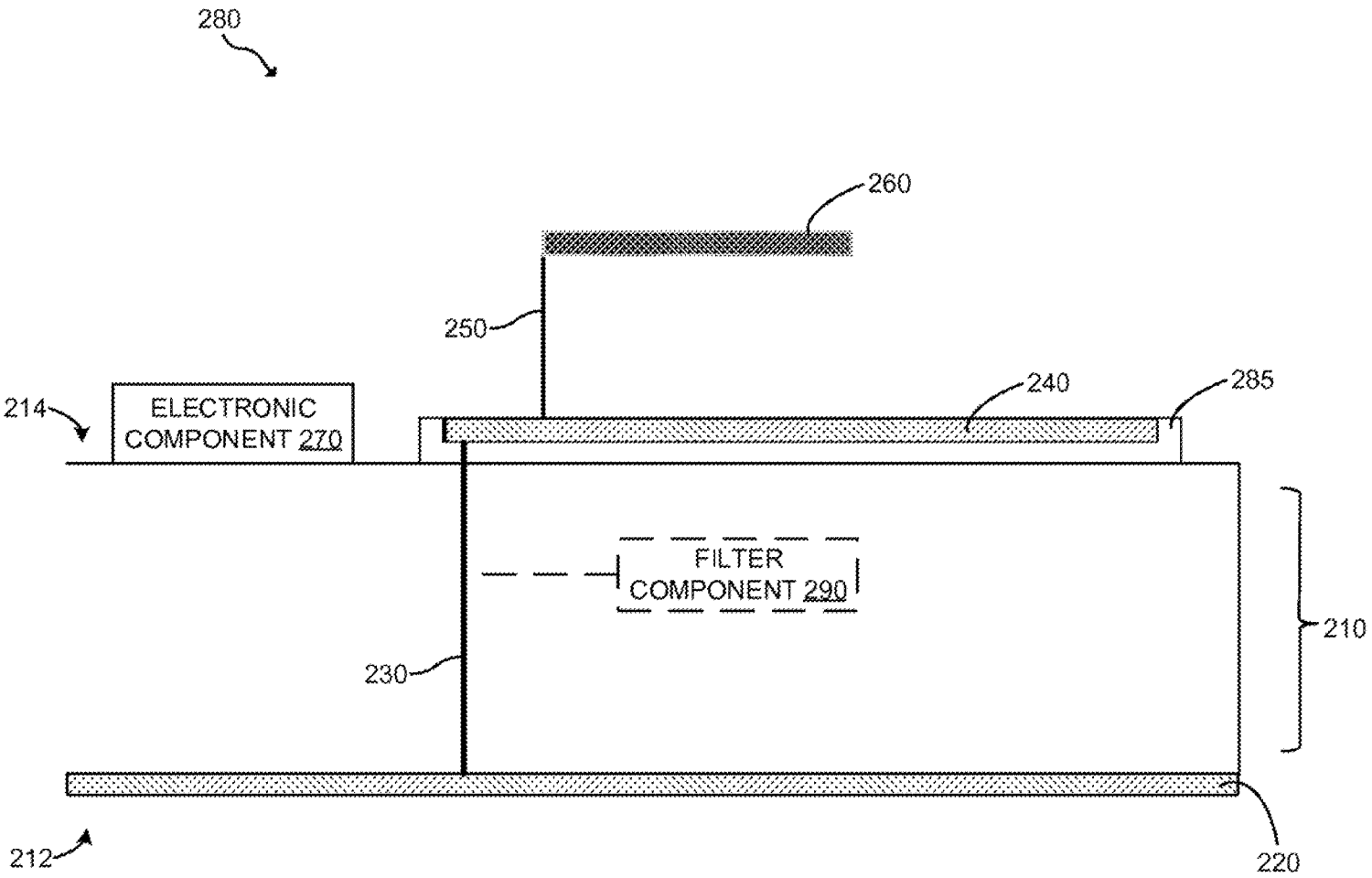
FIG. 2B is a cross-sectional side view of an example antenna system with bridged ground planes.

FIG. 2B is a cross-sectional side view of example antenna system 280 with bridged ground planes. Similar to antenna system 200 of FIG. 2A, antenna system 280 may include a motherboard 210, a first ground plane 220, a bridge 230, a second ground plane 240, an antenna connection 250, an antenna radiating element 260, and at least one electronic component 270. Additionally, antenna system 280 may have a moat 285 and at least one filter component 290. As shown in FIG. 2B, first ground plane 220 may be on a first face 212 of motherboard 210, and second ground plane 240 may be on second face 214. Bridge 230 may pass through motherboard 210 to couple first ground plane 220 and second ground plane 240.

Moat 285 may separate second ground plane 240 from directly contacting second face 214 of motherboard 210. Physically separating second ground plane 240 from motherboard 210 may serve to prevent electronic interference between motherboard 210 and the rest of antenna system 280, including antenna radiating element 260. The width of moat 285 may vary with each implementation. In some examples, moat 285 may have a width of about one to two millimeters. Moat 285 may be cut from second face 114 to create a gap between the edges of second ground plane 240 and second face 114. Alternatively, as shown in FIG. 2B, moat 285 may have a physical structure that is placed between second ground plane 240 and second face 114 of motherboard 210.

Antenna system 280 may include at least one filter component 290. Filter component 290 may be a device or component that mitigates noise travelling from motherboard 210 to antenna radiating element 260 and from antenna radiating element 260 to motherboard 210. Noise may be random fluctuations in electrical signals that may interfere with intended operations of electric devices and systems. For example, due to the close proximity of electronic components 270 to the other components of antenna system 280, unwanted electrical noise may interfere between the operations of electronic component 270 and the other components, such as antenna radiating element 260.

Filter component 290 may include a number of devices or components that operate to filter a number of types of noise, including, but not limited to, thermal noise, shot noise, flicker noise, and other forms of electrical noise. Non-limiting examples of filter component 290 may include ferrite beads, capacitors, inductors, faraday cages, shielding, wire twists, and notch filters. In some examples, such as the one depicted by FIG. 2B, filter component 290 may be attached or be a portion of bridge 230. In one example, filter component 290 may be attached to bridge 230 and include at least one of a ferrite bead, an inductor, and a capacitor. In such examples where bridge 230 couples each edge of second ground plane 240 to first ground plane 220, each edge or side of bridge 230 may include at least one filter component 290.

Filter component 290 may be designed to filter noise at certain frequencies. For example, antenna system 280 may be designed to send and receive radio waves of certain frequencies. Accordingly, filter component 290 may be designed to boost the performance and reliability of antenna system 280 by filtering noise at desired frequencies. In one example, an antenna system 280 utilized in a mobile phone may have a filter component 290 that targets noise caused by signals in the WWAN/LTE frequencies bands.

Figure 3:
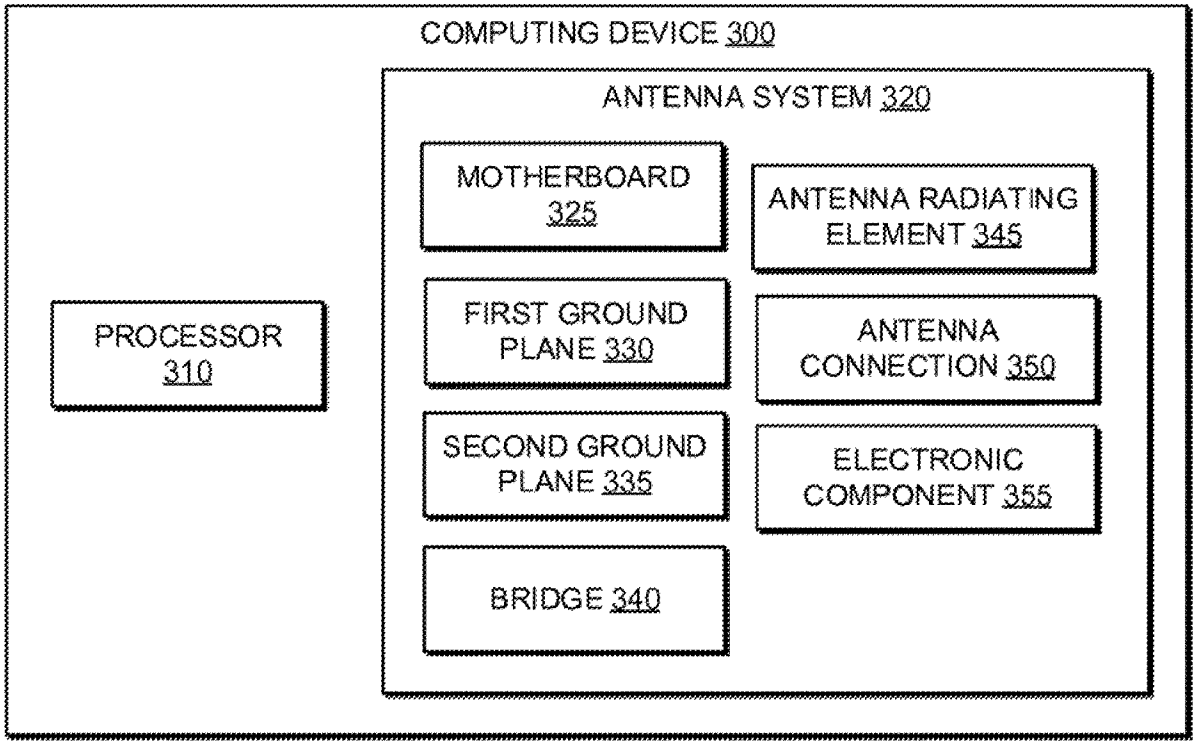
FIG. 3 is a block diagram of an example cornputing device having an antenna system with bridged ground planes.

FIG. 3 depicts an example computing device 300 having an antenna system 320 with bridged ground planes. Computing device 300 may be, for example, a notebook computer, tablet computer, cellular phone, PDA, communications device such as a radio, wireless server, router, or any other electronic device that may utilize an antenna system. In the example implementation of FIG. 3, computing device 300 includes a processor 310.

Processor 310 may be one or more central processing units (CPUs), semiconductor-based microprocessors, and/or other hardware devices suitable for retrieval and execution of computer instructions. In example implementations where computing device may communicate with a mobile network, for example a cellular network or a wireless local area network, antenna system 110 may operate to convert electronic waves of a mobile network into an electrical current, and vice versa, to enable exchanges of data between computing device 300 and a network.

Similar to example antenna system 100 described in detailed in relation to FIG. 1, antenna system 320 may include a motherboard 325, first ground plane 330, second ground plane 335, bridge 340, antenna radiating element 345, antenna connection 350, and electronic component 355. First ground plane 330 may be coupled to a first face of motherboard 325. Bridge 340 may couple first ground plane 330 to second ground plane 335. Antenna radiating element 345 may be coupled to second ground plane 335 via antenna connection 350, and electronic component 355 may be coupled to a second face of motherboard 325. As described above, antenna system 320 may reduce the design dimensions of computing device 300 by leveraging the bridge design between second ground plane 335, which may operate as an antenna ground, and first ground plane 330, which may operate as a motherboard ground.

In some examples, second ground plane 335 may be coupled by bridge 340 to the second face of motherboard 325, opposite first ground plane 330 which is coupled to the first face of motherboard 325. In such examples, bridge 340 may pass through motherboard 325. Furthermore, antenna system 320 may, in some examples, include at least one filter component for filtering noise from motherboard 325 to antenna radiating element 345 and vice versa. Further details regarding filter components are discussed in relation to FIG. 2B.

Figure 4B:
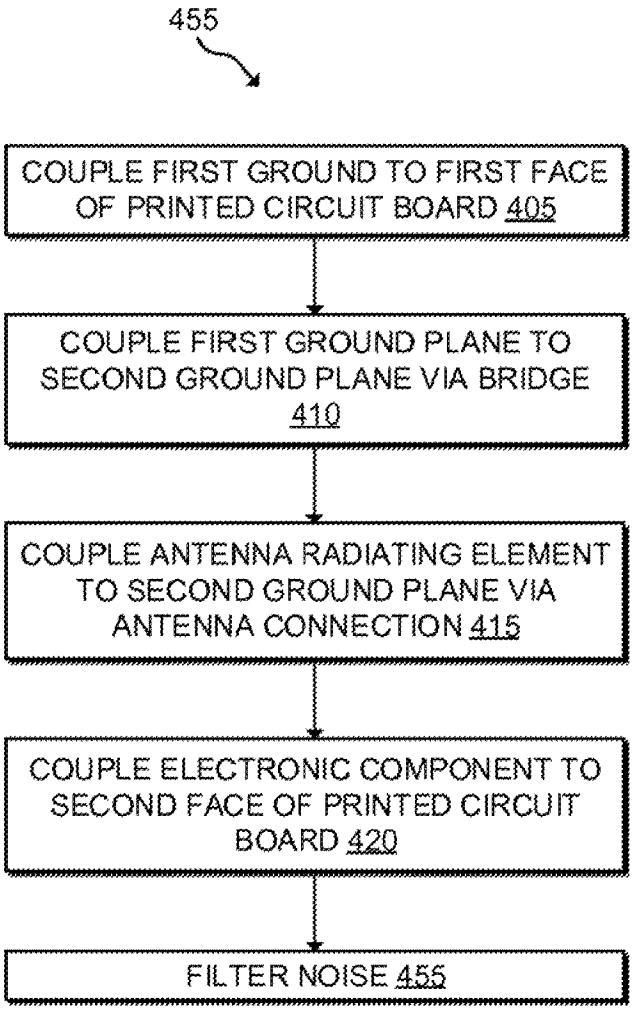
FIG. 4B is a flowchart of an example method for improving performance of an antenna system including filtering noise.
Figure 4A:
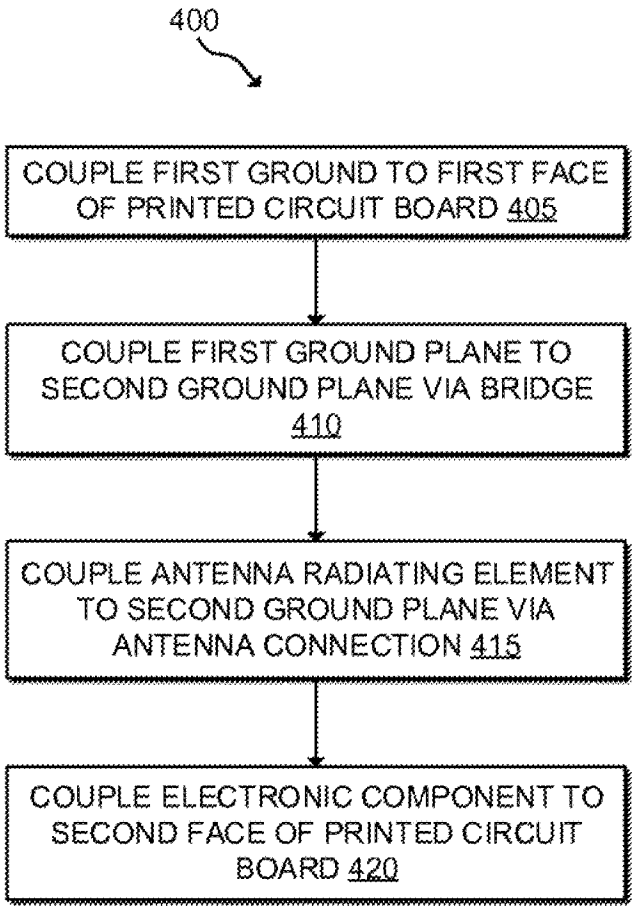
FIG. 4A is a flowchart of an example method for improving performance of an antenna system.

FIG. 4A is a flowchart of an example method 400 for improving performance of an antenna system, which may include 405 for coupling a first ground plane to a first face of a printed circuit board; 410 for coupling the first ground plane to a second ground plane via a bridge which has at least one filter component; 415 for coupling an antenna radiating element to the second ground plane via an antenna connection; and 420 for coupling at least one electronic component to a second face of the printed circuit board. Although execution of method 400 is herein described in reference to antenna system 100 of FIG. 1, other suitable parties for implementation of method 400 should be apparent, including, but not limited to, antenna system 200 of FIG. 2A and antenna system 280 of FIG. 2B. It should further be understood that method 400 is not limited by the sequence described in relation to the example herein. 405, 410, 415, 420 may be performed in a variety of sequential or concurrent combinations.

Method 400 may start in 405, where first ground plane 120 is coupled to first face 112 of printed circuit board 110. First ground plane 120 may be an electrically conductive surface that may serve as a return path for current from different components on printed circuit board 110. In some examples, first ground plane 120 may cover the entire first face 112 of printed circuit board 110. First ground plane 120 may have an electrically conducting material, such as a layer of copper foil. First ground plane 120 may have varying thicknesses, but generally, it has a thin conducting layer.

After coupling first ground plane 120, method 400 may proceed to 410, where second ground plane 140 is coupled to first ground plane 120 via bridge 130, The coupling by bridge 130 may form an electrically conducting path between first ground plane 120 and second ground plane 140. In some examples, bridge 130 may have a thin conducting material, such as copper foil. As described in detail above, second ground plane 140 may be coupled to first ground plane 120 on first face 112 of printed circuit board 110. Alternatively, in other examples, first ground plane 120 and second ground plane 140 may be coupled on different faces of printed circuit board 110 with bridge 230 passing through printed circuit board 110.

Second ground plane 140 may be antenna ground plane, which may be an electrically conducting surface that reflects radio waves from other elements, such as antenna radiating element 160. In some examples, second ground plane 140 may be at least a quarter of the wavelength of a radio wave in size in order to function as an antenna ground plane for that radio wave. Second ground plane 140 may have an electrically conducting material, such as a layer of copper foil. When second ground plane 140 and first ground plane 120 are coupled by bridge 130, first ground plane 120 may be leveraged to boost the performance of second ground plane 140. In some examples, such as ones described herein, first ground plane 120 may be larger than second ground plane 140 because first ground plane 120 may cover the entire first face 112 of printed circuit board 110. Accordingly, by leveraging the larger first ground plane 120, antenna system 100 may be resonant at lower frequencies than would be possible with solely using second ground plane 140.

After coupling the ground planes via bridge 130, method 400 may proceed to 415, where antenna radiating element 160 is coupled to second ground plane 140 via antenna connection 150. As described in detail above, antenna connection 150 may include a transmission line, where electric current is fed to and from antenna radiating element 160, and an electrical shorting pin or plate which may operate to decrease the required size for the antenna.

Antenna radiating element 160 may be a patch or other shape that radiates and receives radio waves. Antenna radiating element 160 may have an electrically conducting material, such as copper. In some examples, a substrate separates antenna radiating element 160 and second ground plane 140. In other words, second ground plane 140 and antenna radiating element 160 may sit on opposite faces of the substrate. A substrate may have a dielectric material that facilitates fringing electric fields between second ground plane 140 and antenna radiating element 160. Fringing electric fields may allow the system to operate similarly to a patch antenna or planar inverted-f antenna. A substrate may be any material with a dielectric constant, including mechanical structures or air. For the former examples, a substrate may provide mechanical support to the structure and may be, for example, a circuit board.

After coupling antenna radiating element 160 to second ground plane 140, method 400 may proceed to 420, where electronic component 170 is coupled to second face 114 of printed circuit board 110. Electronic component 170 may be a variety of electrical devices that may operate while coupled to printed circuit board 170. For example, electronic component 170 may be a central processing unit, memory devices, and various other components. It should be noted that electronic component, as used herein, does not include first ground plane 120, bridge 130, second ground plane 140, antenna connection 150, or antenna radiating element 160. In some examples, all electronic components 170 that are coupled to printed circuit board 110 are coupled to second face 114 of printed circuit board 110. in other words, no electronic components are coupled to first face 112 of printed circuit board 110.

FIG. 4B is a flowchart of an example method 450 for improving performance of an antenna including filtering noise. Method 450 may include method 400 and block 455 for filtering noise from the motherboard (or other circuit board) to the antenna radiating element and from the antenna radiating element to the motherboard. Although execution of method 450 is herein described in reference to antenna system 280 of FIG. 2B, other suitable parties for implementation of method 450 should be apparent, including, but not limited to, antenna system 100 of FIG. 1 and antenna system 200 of FIG. 2A. It should further be understood that 405, 410, 415, and 420 are not limited by the sequence described in relation to the example herein. 405, 410, 415, 420 may be performed in a variety of sequential or concurrent combinations.

455 includes filtering noise from motherboard 210 to antenna radiating element 260 and from antenna radiating element 260 to motherboard 210. During operations of antenna system 280, noise may be caused by random fluctuations in electrical signals traveling through the system that may interfere with intended operations of antenna system 280. Antenna system 280 may include at least one filter component 290 that filters unwanted noise. Filter component 290 may include a number of devices or components that filter thermal noise, shot noise, flicker noise, or other forms of electrical noise. Non-limiting examples of filter component 290 may include ferrite beads, capacitors, inductors, faraday cages, shielding, wire twists, and notch filters.

Filter component 290 may be designed to filter noise at certain frequencies. For example, antenna system 280 may be designed to send and receive radio waves of certain frequencies. Accordingly, filter component 290 may be designed to boost the performance and reliability of antenna system 280 by filtering noise at desired frequencies. In one example, an antenna system 280 utilized in a mobile phone may have a filter component 290 that targets noise caused by signals in the WWAN/LTE frequencies bands.

The foregoing describes a number of examples for antenna systems with bridged ground planes. It should be understood that the antenna systems described herein may include additional components and that some of the components described herein may be removed and/or modified without departing from the scope of the antenna system. It should also be understood that the components depicted in the figures are not drawn to scale and thus, the components may have different relative sizes with respect to each other than as shown in the figures.

What is claimed is:

1. An antenna system in a mobile computing device, comprising: a printed circuit board comprising a motherboard of the mobile computing device; a first ground plane for the motherboard that is coupled to a first face of the printed circuit board; a bridge coupling the first ground plane to a second ground plane; and an antenna radiating element coupled to the second ground plane via an antenna connection; further comprising an additional component coupled between the second ground plane and the antenna radiating element, the additional component comprising a capacitor to balance capacitance and inductance of the antenna system.

2. The antenna system of claim 1, wherein all electronic components that are coupled to the printed circuit board are coupled to a second face of the printed circuit board.

3. The antenna system of claim 1, wherein the second ground plane is coupled to the first ground plane via the bridge on the first face of the printed circuit board, both the first and second ground planes being on a same side of the printed circuit board.

4. The antenna system of claim 1, wherein the second ground plane is coupled to the second face of the printed circuit board and wherein the bridge is electrically conducting to electrically connect the first and second ground planes and passes through the printed circuit board.

5. The antenna system of claim 1, further comprising a moat separating the second ground plane from the second face of the printed circuit board.

6. The antenna system of claim 3, wherein the first ground plane and the second ground plane are positioned closer to the first face than to the second face of the printed circuit board.

7. The antenna system of claim 1, wherein the second ground plane comprises a rectangular shape.

8. The antenna system of claim 7, wherein the bridge couples each edge of the second ground plane to the first ground plane.

9. The antenna system of claim 1, wherein the antenna system comprises a filter component for filtering noise from the printed circuit board to the antenna radiating element and from the antenna radiating element to the printed circuit board.

10. The antenna system of claim 9, wherein the filter component comprises one of a ferrite bead, a capacitor, and an inductor.

11. A device with an antenna system comprising:

a circuit board comprising a motherboard of a mobile computing device;

a first ground plane of the motherboard that is coupled to a first face of the motherboard;

an electrically conducting bridge electrically coupling the first ground plane to a second ground plane on a second, opposite face of the circuit board and wherein the bridge passes through the motherboard; and an antenna radiating element coupled to the second ground plane via an antenna connection;

wherein the antenna system comprises a filter component for filtering noise, the filter component being embedded inside the circuit board.

12. The device of claim 11, wherein the first ground plan is a return path for current from components of the motherboard.

13. A method, comprising:

coupling a first ground plane to a first face of a printed circuit board;

coupling the first ground plane to a second ground plane via a bridge, wherein the bridge comprises a filter component;

coupling an antenna radiating element to the second ground plane via an antenna connection;

coupling an electronic component to the printed circuit board; and filtering noise from the printed circuit board to the antenna radiating element and from the antenna radiating element to the printed circuit board with a filter that is embedded interior to material of the circuit board.

14. The method of claim 13, further comprising using the first ground plane as a return path for current from components on the printed circuit board.

15. The device of claim 11, wherein the first ground plane is a return path for current from a component coupled to the circuit board.

16. The device of claim 11, further comprising:

a shorting pin at one end of the antenna radiating element; and a transmission line between a shorted end and an opposite end of the antenna radiating element.

17. The method of claim 13, wherein the circuit board is a motherboard.

18. The device of claim 11, further comprising a moat formed on a surface of the circuit board and disposed between the second ground plane and the circuit board.

* * * * *